US007628251B2

(12) United States Patent
Kocher

(10) Patent No.: US 7,628,251 B2
(45) Date of Patent: Dec. 8, 2009

(54) ELEVATOR INSTALLATION WITH A LINEAR DRIVE SYSTEM

(75) Inventor: Hans Kocher, Udligenswil (CH)

(73) Assignee: Inventio AG, Hergiswil NW (CH)

( * ) Notice: Subject to any disclaimer, the term of this patent is extended or adjusted under 35 U.S.C. 154(b) by 475 days.

(21) Appl. No.: 11/672,654

(22) Filed: Feb. 8, 2007

(65) Prior Publication Data

US 2007/0199770 A1 Aug. 30, 2007

(30) Foreign Application Priority Data

Feb. 8, 2006 (EP) ..... 06101413

(51) Int. Cl.
*B66B 1/06* (2006.01)

(52) U.S. Cl. ..... 187/289; 187/277

(58) Field of Classification Search ..... 187/277, 187/289, 293, 295; 318/135, 38, 657, 687; 310/12

See application file for complete search history.

(56) References Cited

U.S. PATENT DOCUMENTS 5,203,432 A * 4/1993 Grinaski ..... 187/251
5,234,079 A * 8/1993 Nomura ..... 187/250
5,235,226 A * 8/1993 Olsen et al. ..... 310/12.11
5,668,421 A 9/1997 Gladish et al.
5,751,076 A * 5/1998 Zhou ..... 310/12.11
5,801,462 A * 9/1998 Yagoto et al. ..... 310/12.19
5,808,381 A * 9/1998 Aoyama et al. ..... 310/12.29
5,975,249 A 11/1999 Tomaseti
6,189,657 B1 * 2/2001 Jessenberger ..... 187/289
6,305,501 B1 * 10/2001 Kahkipuro et al. ..... 187/289
6,742,631 B2 * 6/2004 Grundmann ..... 187/315
7,261,186 B2 * 8/2007 Deplazes et al. ..... 187/277
7,478,706 B2 * 1/2009 Kocher et al. ..... 187/293
2005/0087400 A1 4/2005 Zhou

FOREIGN PATENT DOCUMENTS

EP 0785162 A 7/1997
JP 04089787 A 3/1992
JP 06080353 A * 3/1994

* cited by examiner

*Primary Examiner*—Walter Benson
*Assistant Examiner*—Eduardo Colon-Santana
(74) *Attorney, Agent, or Firm*—Fraser Clemens Martin & Miller LLC; William J. Clemens

(57) ABSTRACT

An elevator installation has an elevator car and a permanent magnet linear drive system with a stationary part and a movable part, which moves along the stationary part when the permanent magnet linear drive system is controlled in a drive mode. The elevator car is arranged in a rucksack configuration. The stationary part has two inclined interaction surfaces which include an angle between 0° and 180°. The movable part comprises two units which are so arranged in common on a rear side of the elevator car and mechanically positively connected with the elevator car that in the case of drive control each of the two units produces a movement along one of the interaction surfaces in order to thus move the elevator car.

15 Claims, 5 Drawing Sheets

ELEVATOR INSTALLATION WITH A LINEAR DRIVE SYSTEM

BACKGROUND OF THE INVENTION

The present invention relates to an elevator installation with a linear drive system and a linear drive system for an elevator installation.

Different elevator configurations with linear motor drive systems are known. However, in elevator configurations of that kind the most diverse problems arise, which previously could be solved only in part. This is due to the fact, inter alia, that the problems are in part diametrically opposed and the isolated solution of one of the problems is frequently accompanied by problems in other areas.

This conflict is explained in the following by way of an example. Linear motor drive systems, particularly those operating with permanent magnets, have very high attraction forces between a primary- or stationary-part and a secondary- or movable-part. If use is now made of such a permanent magnet linear motor not only as a direct drive system, but also as support means of the elevator car then a precise and secure guidance of the elevator car has to be guaranteed. With respect thereto FIGS. 1A, 1B, 2A and 2B show different basic configurations of prior art elevator installations with permanent magnet linear drive systems.

A configuration is shown in FIGS. 1A and 1B in which an elevator car 13 is moved by means of a permanent magnet linear drive system 10, 11 along an elevator shaft in a "y" direction. Such a permanent magnet linear drive system typically comprises a stationary part 10, which is fastened in the shaft, and a movable part 11, which is fastened to the elevator car 13. It can be seen from the plan view in FIG. 1B that no guidance in the "y-z" plane is effected in such a configuration, so that additional guide shoes have to be provided at the elevator car 13 to guide the elevator car 13 along guide rails 12 arranged on the right and the left near the elevator car 13. A comparable elevator installation is shown in the European patent application EP 0 785 162 A1.

Another basic configuration is shown in FIGS. 2A and 2B. As can be seen in the plan view in FIG. 2B, the permanent magnet linear drive system comprises a stationary part 10 and two movable parts 12. Guidance in the "y-z" plane is thereby achieved. However, in order to avoid tipping in the "x-y" plane guide rails are similarly necessary or the elevator car 13 is carried by further support means such as a cable 12' mounted centrally at the elevator car.

The previously known approaches are therefore technically complicated, require much material and space in the elevator shaft and are thus cost-intensive.

In addition, the known solutions are not suitable or are only conditionally suitable for elevator installations in rucksack configuration, which for constructional or aesthetic reasons require only one wall of the elevator shaft for drive, support means and guidance.

SUMMARY OF THE INVENTION

An object of the present invention is an elevator installation which, with use of a linear motor drive system, demands little space in the elevator shaft.

It is to be regarded as a further object of the present invention to provide a linear motor drive system for an elevator installation in rucksack configuration.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

A configuration of an elevator installation is known in which the technical/mechanical components are typically mounted only at one shaft wall. Such a configuration is also termed a rucksack configuration, since the elevator car sits, like a rucksack, symmetrically on a car frame which, provided with support means, is suspended and guided in the elevator shaft at one side. Due to the fact that only one shaft wall is occupied, the three further walls of the elevator car are freely selectable as accesses and accordingly can have up to three car doors. The at least one car door can adjoin the rear wall provided for the technical/mechanical components, in which case it is known as a side rucksack configuration, or it can be mounted at the front wall of the elevator car disposed opposite this rear wall, which is termed a normal rucksack configuration. The expert has with respect thereto numerous possibilities of realization.

Figure 1A:
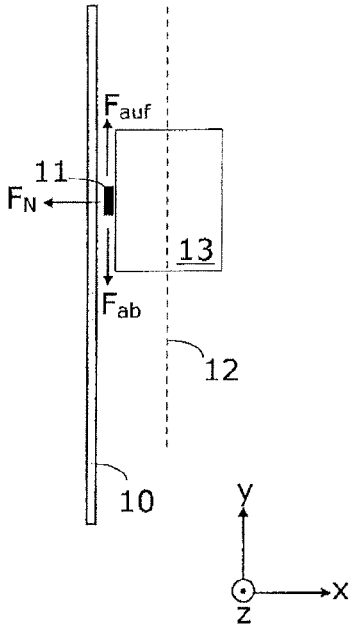
Fig. 1A (PRIOR ART)
FIG. 1A is a schematic side view of a part of a first prior art elevator installation with a linear drive system.
Figure 3:
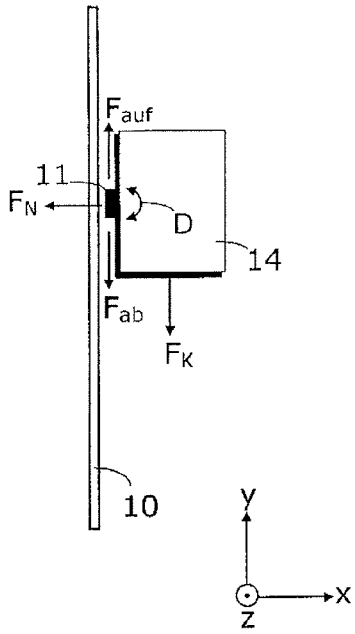
Fig. 3 (PRIOR ART)
FIG. 3 is a schematic side view of a part of a third prior art elevator installation with a linear drive system, wherein an elevator installation in rucksack configuration is concerned.

The rucksack principle is now transferred to an elevator installation with a permanent magnet linear drive system as shown in FIG. 3, this being a schematic illustration. As indicated in FIG. 3, an elevator car 14 is seated on an L-shaped car frame, to the upright limb of which the movable part 11 of the permanent magnet linear drive system is fastened. The stationary part 10 of the drive is fastened perpendicularly in the elevator shaft (analogously to the arrangement shown in FIG. 1A). Between the movable part 11 and the stationary part 10 there are strong attraction forces which are oriented in the normal direction and denoted by $F_N$. If the drive system is controlled in drive in a suitable mode and manner the elevator car 14 can be moved upwardly or downwardly as illustrated by the force vectors $F_{auf}$ and $F_{ab}$. In the case of a rucksack configuration of the illustrated format there is now added a torque D which is caused by the weight $F_K$ of the laden or unladen elevator car 14 and which acts on the permanent magnet linear drive system, as indicated by a double headed arrow.

Figure 1B:
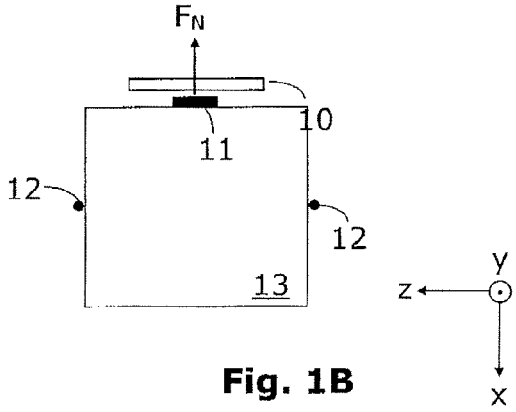
Fig. 1B (PRIOR ART)
FIG. 1B is a schematic plan view of the first elevator installation shown in FIG. 1A.
Figure 2A:
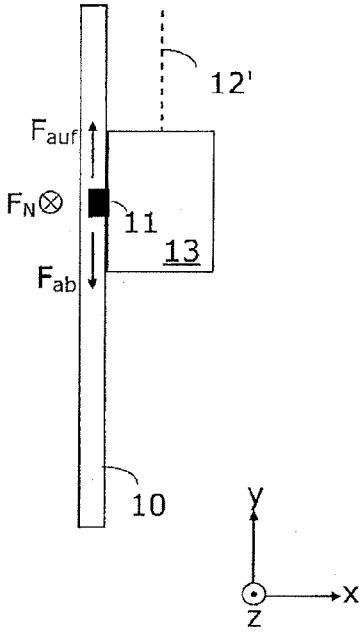
Fig. 2A (PRIOR ART)
FIG. 2A is a schematic side view of a part of a second prior art elevator installation with a lineal drive system.
Figure 2B:
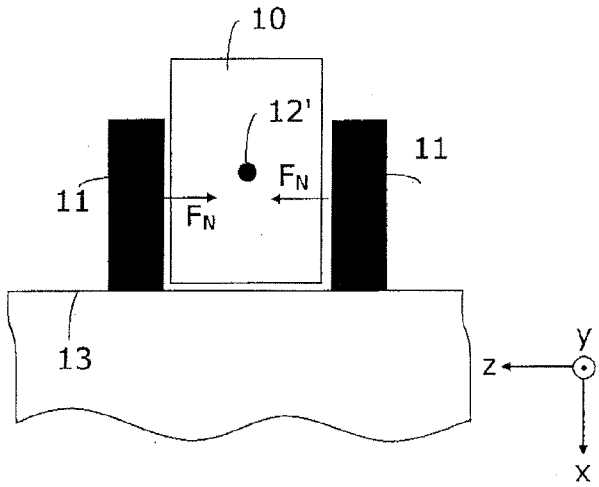
Fig. 2B (PRIOR ART)
FIG. 2B is a schematic plan view of the second elevator installation shown in FIG. 2A.

Special measures are obviously necessary in order to ensure for this rucksack configuration a precise and secure guidance of the elevator car 14. However, such guides would oblige, if the known approaches are followed, further mechanical guide elements near the elevator car 14 (for example, the lateral guide rails 12 such as in FIG. 1B) and/or above the elevator car 14 (for example, a guide cable 12' as in FIG. 2A).

According to the present invention a completely different route is followed as is described in the following with reference to the schematic FIGS. 4A and 4B.

Figure 4A:
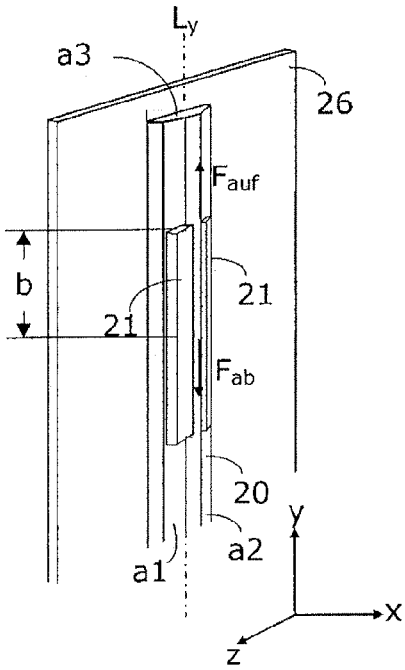
FIG. 4A is a schematic perspective view of a part of a first elevator installation according to the present invention with two movable parts.

In FIG. 4A a schematic perspective view of a part of a shaft rear wall 26 with the parts 20, 21 of the permanent magnet linear drive system serving as a direct drive is shown. The stationary part 20 (also termed a support column) of the drive system is fastened to the shaft rear wall 26 and has a longitudinal axis $L_y$ extending parallel to the "y" direction. In departure from the previously known stationary parts, at least two interaction surfaces a1, a2 arranged at an inclination relative to one another are provided at the stationary part 20. Moreover, the drive system comprises at least two movable parts 21 (also termed units), wherein each of the movable parts 21 is associated with a respective one of the interaction surfaces a1 and a2. An interaction length b oriented in y direction is associated with each interaction surface a1, a2. The interaction length b is the length between a guide point at the end and the center of the movable part 21. Whereas repelling forces arise at the end guide point, attractive forces are effected in the center point of the movable part 21. The interaction length b is thus the effective length preventing tipping movement of the elevator car 24 in the "x-y" plane. The interaction length b extends over a part region of the elevator car 24, it being smaller than the height of the elevator car 24. If the drive system is controlled in drive in a suitable mode and manner then the elevator 24 can be moved upwardly or downwardly as illustrated by the force vectors $F_{auf}$ and $F_{ab}$. The ratio of attraction force $F_N$ divided by force vectors $F_{auf}$ and $F_{ab}$ is termed force ratio "K". A force ratio "K" typically lies in the range of two to twenty, preferably in the range of three to ten.

Figure 4B:
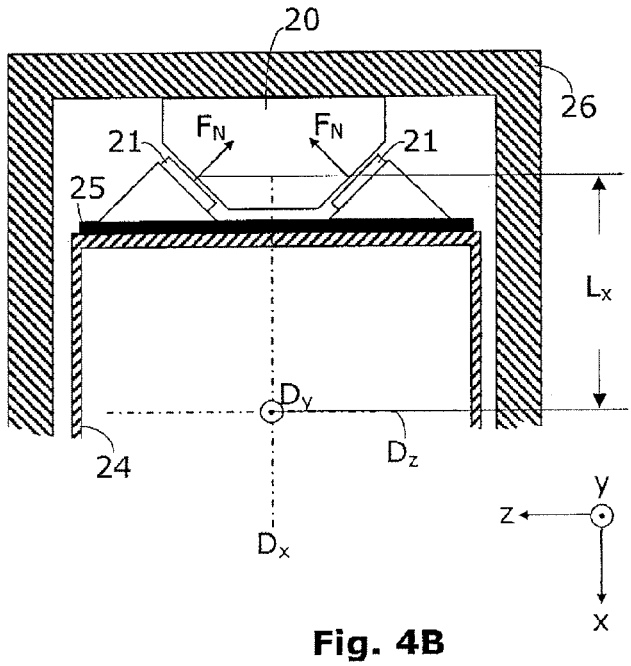
FIG. 4B is a schematic plan view of the first elevator installation shown in FIG. 4A.

In FIG. 4B it can be seen by way that the elevator car 24 is arranged in a rucksack configuration. In order to be able to characterize the elevator car 24, the rotational axes $D_x$ $D_y$ and $D_z$ acting at the car center of gravity are illustrated in FIG. 4B. Between the movable parts 21 and the interaction surfaces a1, a2 of the stationary part 20 there are strong attraction forces which are oriented in normal direction and again denoted by $F_N$. The spacing between the car center of gravity of the interaction surfaces a1, a2 is denoted as a line of action $L_x$. According to FIG. 4B the center connecting line, which extends in the "z" direction, of the interaction surfaces a1, a2 is used as reference for the determination of spacing. The line of action $L_x$ is accordingly the shortest distance between the car center of gravity and this center connecting line. For optimization of the efficiency of the permanent magnet linear drive system the parts 20, 21 are spaced apart by a smallest possible air gap. The air gap is, for example, one millimeter wide. In constructional terms the air gap has the advantage that it enables a contactless guidance of each of the movable parts 21 on the corresponding stationary part 20. The vertical movement of the elevator car 24 is thus contactlessly guided on the stationary part by way of the permanent magnet linear drive system via the movable parts 21.

By virtue of the inclined orientation of the interaction surfaces a1, a2 relative to one another there results, according to the present invention, a spatial, i.e. 3-dimensionally acting, guidance. Thus, rotation or tipping of the elevator car 24 about the axes $D_x$, $D_y$ and $D_z$ of rotation is prevented. Through this novel combination, in particular, the torques (torque D in FIG. 3) caused by the rucksack combination are absorbed. Stated in other words, compensation for the disadvantage of eccentric suspension of the elevator car 24 is provided by the special design of the permanent magnet linear drive system. The ratio of line of action $L_x$ divided by the interaction length b is termed eccentricity "$L_x$/b". The eccentricity is typically 0.1 to 1.6, preferably 0.2 to 0.8.

The expression permanent magnet linear drive system is used in the present context in order to denote a direct drive system comprising a synchronous linear motor excited by permanent magnets. The corresponding surfaces of the stationary part of the permanent magnet linear drive system are termed interaction surfaces, since an interaction takes place between the surfaces and the movable units of the drive system.

Instead of a linear drive system which comprises at least one permanent magnet it is also possible to use a linear drive system which comprises at least one layer structure with at least one coil. The movable part can be conceived as a layered structure produced by application of different layers on the substrate.

The layers can be applied in succession and optionally suitably structured. In this manner three-dimensional structures of materials with different characteristics can be applied to the substrate. Individual layers can consist of an electrically insulating material or comprise regions of an electrically insulating material. The conductor track can be composed of conductor track sections respectively formed in different layers of the layer structure. Individual sections of the conductor track can cross over, for example, in different planes and be separated in the crossover region by an electrically insulating layer. Moreover, the possibility exists of arranging individual sections of the conductor track in different layers separated by an intermediate layer and providing in the intermediate layer an electrically conductive region which produces an electrical connection between these sections of the conductor track.

Layers of the stated kind can also be applied on both sides of the substrate and optionally structured. It is provided, for example, that a first part of the conductor track is formed at a first surface of the substrate and a second part of the conductor track at a second surface of the substrate, wherein an electrical connection is produced between the first and the second part. This makes it possible to impart a particularly complex geometric structure to the conductor track.

In a variant of the movable part at least one section of the conductor track can have, for example, the form of a coil, wherein each coil comprises one or more windings. The coil can be arranged on one side of a substrate, but it can also be composed of different sections of the conductor track which are arranged on different sides of the substrate and electrically connected together.

In a further variant of the movable part several serially arranged sections of the conductor track can each have the form of a coil, wherein the coils are constructed in such a manner that, in the case of a current flow through the conductor track, adjacent coils produce respective magnetic fields with different polarity. The conductor track can be arranged in such a manner that, for example, in the case of supply of the conductor track with a direct current there is produced at a surface of the movable part a static magnetic field, the polarity of which has a periodic polarity reversal along the direction in which the movable part is movable relative to the stationary part. In this manner a movable part for provision of a large number of magnetic poles can be constructed. With a suitable arrangement of the conductor track the area available on the substrate can be efficiently utilized. This is relevant for optimization of the efficiency of the linear drive system and the accuracy with which the movement of the movable part relative to the stationary part can be controlled during operation of the linear drive system.

Further details of the present invention are explained in the following.

The two inclined interaction surfaces a1, a2 extend parallel to the longitudinal axis $L_y$ and lie in planes including an angle W greater than 0° and smaller than 180° (i.e., 0°<W<180°). The surface normals of the interaction surfaces a1, a2 are inclined towards the elevator car 24.

The size of the angle W is a function of the force ratio "K" and the eccentricity "$L_x$/b". With consideration of the arbitrarily selected safety condition that only 20% of the attraction force shall suffice to stabilize the eccentrically loaded rucksack elevator the following dependence results: sin W/2=5*($L_x$/b)/K. The angle W preferably lies between 20% and 160°. For example, the angle W is around 120° for an eccentricity of 0.7 and a force ratio "K" of four.

The movable part comprises at least two of the units 21, which are so arranged in common on a rear side 27 of the elevator car 24 and mechanically positively connected with the elevator car 24 that in the case of drive control each of the two units 21 produces an upward or downward movement along one of the interaction surfaces a1, a2. The elevator car 24 can thereby be moved upwardly or downwardly.

Due to the inclined arrangement of the two interaction surfaces a1 and a2 the attraction forces $F_N$ of the drive system at least partly provide mutual compensation. This assists with avoidance of the disadvantage of the very high attraction forces and friction losses, which are connected with therewith, of previous drive systems with permanent magnet linear drive.

Moreover, it can be recognized in FIG. 4B that the elevator car 24 has at the rear side 27 a car frame 25 or equivalent means at which on the one hand the two units 21 are mechanically positively mounted and which on the other hand is designed for eccentric support of the elevator car 24.

In the illustrated example, the elevator installation is disposed in an elevator shaft, wherein according to the present invention only a form of shaft rear wall 26 is required in order to accept the mechanical/technical elements of the elevator installation.

Figure 5A:
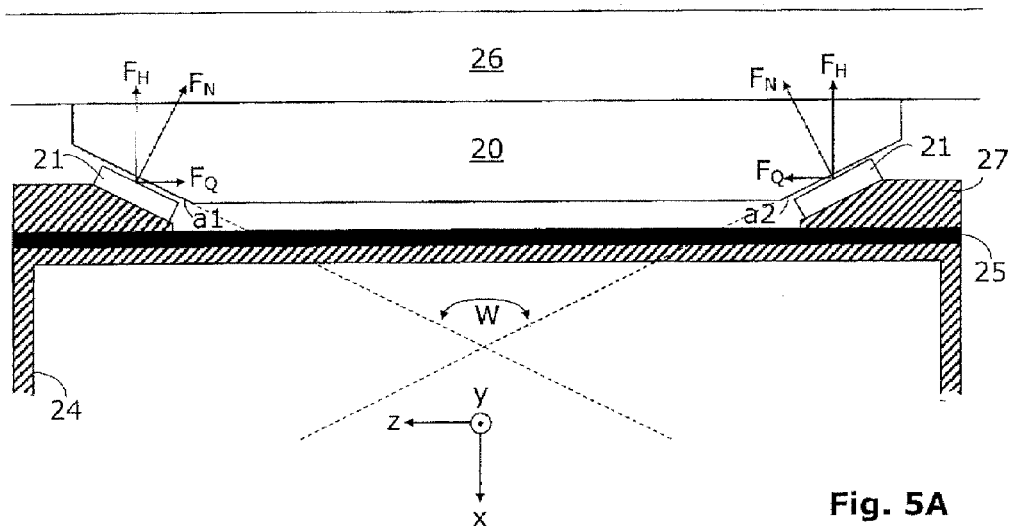
FIG. 5A is a schematic plan view of a part of a second elevator installation according to the present invention.
Figure 5B:
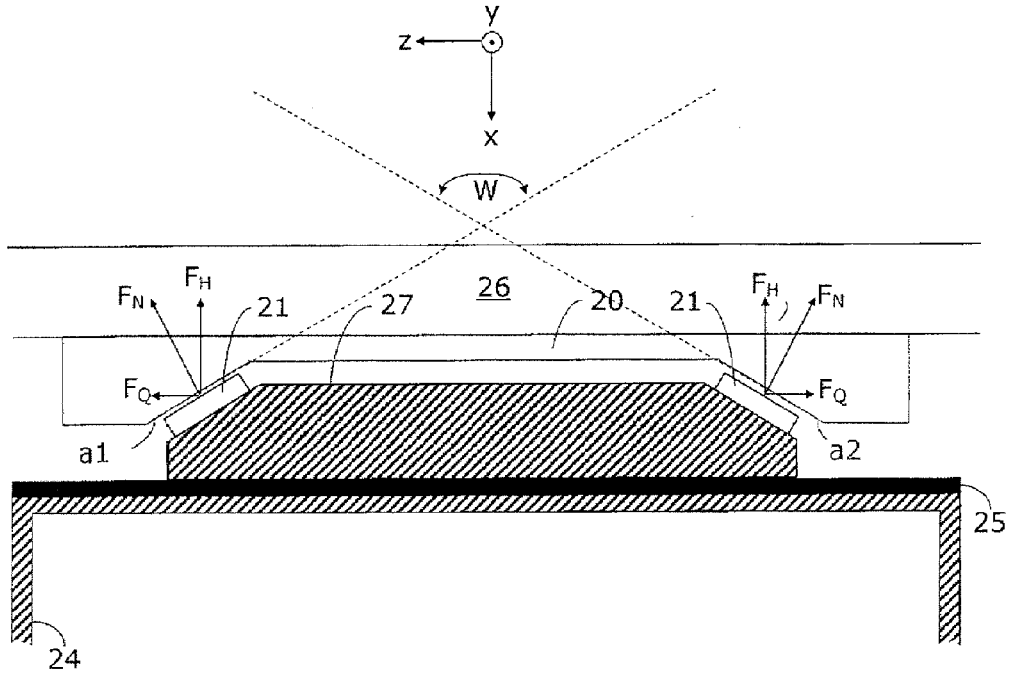
FIG. 5B is a schematic plan view of a part of a third elevator installation according to the present invention.

Two plan views of parts of two further examples of elevator installations according to the present invention are shown in FIGS. 5A and 5B. A rearward shaft wall 26 is shown. The stationary part 20 of the drive system is arranged at or in front of this shaft wall 26. The stationary part 20 has at least two inclined interaction surfaces a1 and a2. Whereas the interaction surfaces a1 and a2 in the example according to FIG. 5A are inclined away from one another, in the example according to FIG. 5B they are inclined towards one another. The angle W is approximately 120°.

The attraction forces $F_N$ of the drive system can be resolved into the force components $F_Q$ (transverse forces) and $F_H$ (holding forces). The two transverse forces of the two units 21 provide mutual compensation, since they are both oriented parallel to the "z" direction, but have mutually opposite directions. In effect, the elevator car 25 is supported by the holding forces $F_H$. Due to this partial compensation of the forces the otherwise existing friction between the stationary part 20 and the movable parts 21 is significantly reduced.

According to the present invention the stationary part 20 is preferably polygonal in cross-section perpendicular to the longitudinal axis $L_y$ and the surface normals of the two interaction surfaces a1, a2 are inclined towards or away from one another. In both instances they face towards the elevator car 24.

By virtue of the inclined arrangement of the interaction surfaces a1, a2 compensation is provided, in particular, for torques $D_z$ which result from the eccentric suspension, caused by the rucksack configuration, of the elevator car 24.

Through the corresponding attraction forces $F_N$ of the unit 21 opposite the respective interaction surface a1, a2 there are produced not only a rotational stabilization of the elevator car 24 about the rotational axis $D_x$ extending perpendicularly to the longitudinal axis $L_y$ and perpendicularly to the rear side of the elevator car 24, but also a rotational 10 stabilization of the elevator car 24 about a rotational axis $D_z$ extending perpendicularly to the longitudinal axis $L_y$ and parallel to the rear side of the elevator car 24. A rotation about the "y" rotational axis $D_y$ is also prevented by the lateral spacing of the units 21.

According to the present invention the attraction forces of the permanent magnets of the permanent magnet linear drive system thus serve for stabilization of the eccentrically arranged elevator car 24 and for three-dimensional stabilization as well as guidance. Due to the eccentrically acting weight force $F_K$ the reaction forces for support of the guide of the drive system are reduced and thereby the friction forces diminished.

Compensation for the transverse forces $F_Q$ and stabilization in the rotational axis $D_z$ can be fixed by a variation of the angle W in the design of an elevator installation or a corresponding permanent magnet linear drive system. The stationary part 20 of the permanent magnet linear drive system is thus used for three-dimensional guidance of the rucksack elevator car 24.

The stationary part 20 has a niche or rest a3 in an upper region. As shown in FIG. 4A as well as FIGS. 7A and 7B, the rest a3 is located on the upper end of the stationary part 20. It is at least partly enclosed by the interaction surfaces a1, a2 and can be used for the mounting of shaft components. Thus, shaft components such as a position transmitter, a brake partner of a holding brake or also a mechanically positive holding lock can be mounted here.

Forms in which the movable parts 21 of the drive system are fastened in the upper region of the car rear side 27 are particularly advantageous.

The forms of the present invention can be realized with or without further support means for supporting the elevator car 24. Such support means are, for example, steel or aramide cables or belts which connect the elevator car 24 with a counterweight.

Figure 7A:
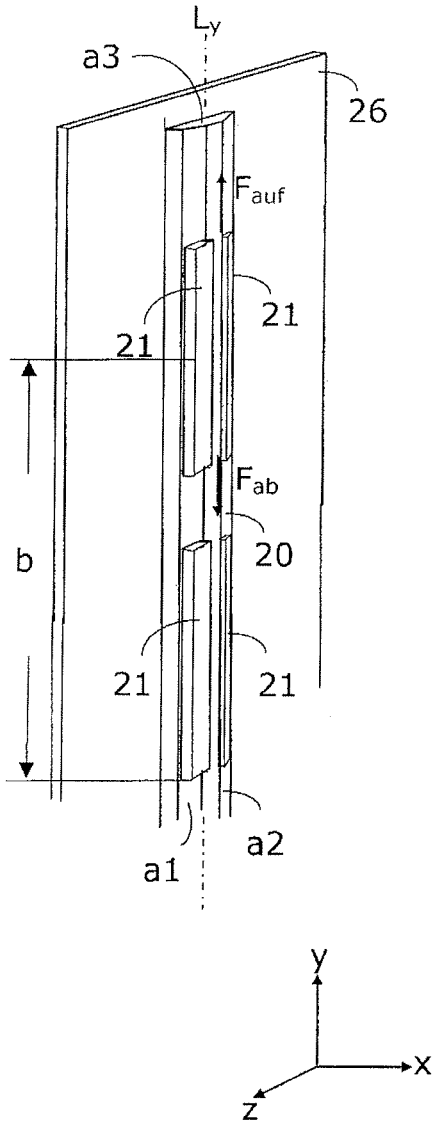
FIG. 7A is a schematic plan view of a part of a fourth elevator installation according to the present invention with four movable parts.
Figure 7B:
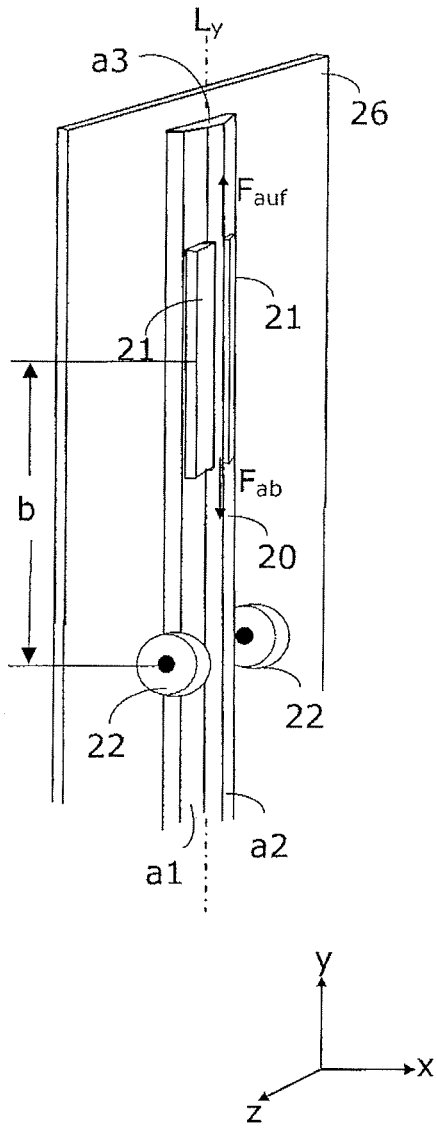
FIG. 7B is a schematic plan view of a part of a fifth elevator installation according to the present invention with an auxiliary guide.

Further advantageous forms of the present invention are shown in FIGS. 7A and 7B. FIG. 7A shows an elevator installation with in each instance two movable parts 21, which are arranged one above the other in the "y" direction, per interaction surface a1, a2. Accordingly, the interaction length b extends from the end guidance point of a first movable part 21 to the center of the second movable part 21 of the same interaction surface a1, a2. FIG. 7B shows an elevator installation with a main guidance in movable parts 21 and an auxiliary guidance in at least one guide shoe 22. Whereas each of the movable parts 21 is guided on one of the two interaction surfaces a1, a2 obliquely inclined relative to one another, the guide shoe 22 is guided laterally adjacent to the stationary part 20 on a guide rail. According to FIG. 7B a respective guide shoe 22 is illustrated on the left and the right of the stationary part 20 per interaction surface a1, a2. Accordingly, the interaction length b extends from the end guidance point in the guide shoe 22 up to the center of the movable part 21 of an interaction surface a1, a2.

According to the present invention the primary part of the drive system can be integrated either in the stationary part 20 or in the movable part 21. The secondary part of the drive system is then disposed in the respective other part.

Preferably, the coils S of the electromagnets (such as can be seen in, for example, FIG. 8) of the primary part of the drive system are seated in the stationary part 20, whilst the permanent magnets of the secondary parts 21 are in the movable part of the drive system. However, the converse arrangement can also be selected.

However, drive systems can also be used in which the primary part comprises not only coils, but also permanent magnets.

Figure 6A:
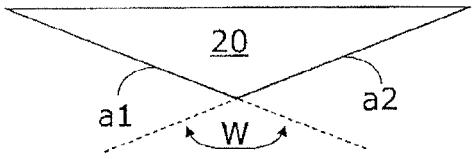
FIG. 6A is an example of a stationary part of a linear drive system according to the present invention in a schematic sectional illustration.
Figure 6B:
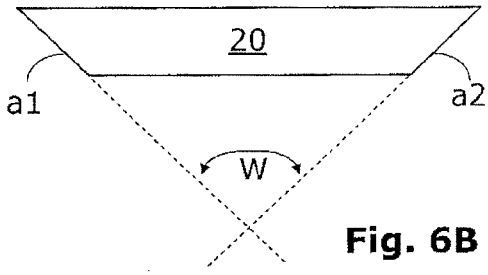
FIG. 6B is a further example of a stationary part of a linear drive system according to the present invention in a schematic sectional illustration.

Further examples of the stationary parts 20 of a permanent magnet linear drive system according to the present invention are shown in sectional illustration in FIGS. 6A and 6B.

Figure 8:
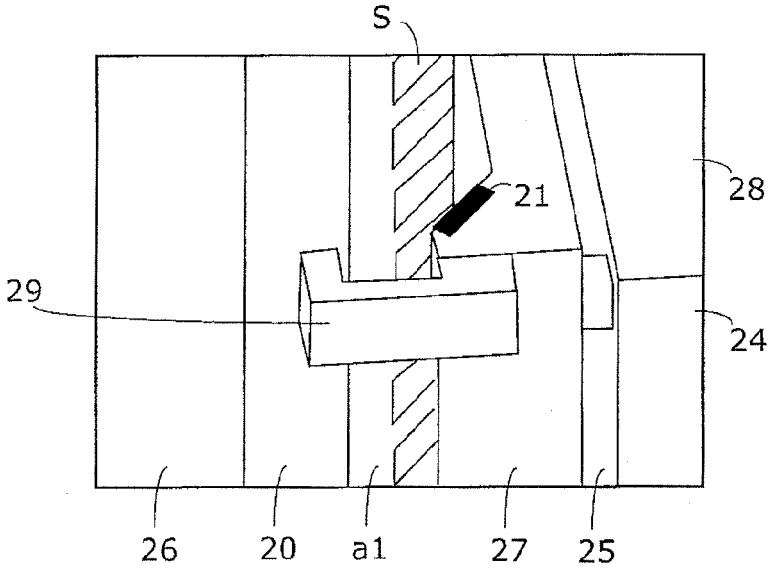
FIG. 8 is a part view of a sixth elevator installation according to present the invention with an emergency guide.

An emergency guide 29 according to the present invention, which in the illustrated example is seated at the top at the car frame 25, is shown in FIG. 8.

The emergency guide 29 engages at least partly around or behind the stationary part 20 in order to prevent tipping away (about the $D_z$ rotational axis) of the elevator system 24 if the permanent magnet linear drive system should fail (for example in the case of a current failure) or if the attraction forces produced by the permanent magnet linear drive system should drop away. The emergency guide 29 is so constructed that in normal operation it runs in a contact-free manner along the stationary part 20. It comes into mechanical engagement only in the case of emergency. Preferably, emergency guides 29 are provided at the two upper corners of the elevator car 24.

It is regarded as an advantage of the illustrated rucksack arrangement with drive system at the car frame 25 that the actual elevator car 24 can be (sound) insulated relative to the frame 25.

The permanent linear drive system according to the present invention and the corresponding elevator installations are space-saving in projection (cross section) of the shaft.

It is of further advantage that compensation for the motor attraction forces is in part provided by the torque produced by the car weight $F_K$ and that due to the contact-free guidance via the air gap no friction losses arise as in the case of conventional arrangements.

It is also advantageous that through the use of at least two of the movable parts 21 a redundancy is given in the drive.

The individual elements and aspects of the different forms of embodiment can be combined with one another as desired.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator installation with an elevator car and a linear drive system with a stationary part, a longitudinal axis of which is arranged in vertically along a shaft wall of the elevator installation, and with a movable part which moves along the stationary part when the linear drive system is controlled in a drive mode, comprising:

the elevator car being arranged in a rucksack configuration and movable by the linear drive system along the stationary part;

the stationary part having at least two inclined interaction surfaces which extend parallel to the longitudinal axis and which lie in a plane, said plane including an angle between 0° and 180° and surface normals of said interaction surfaces being oriented towards the elevator car; and the movable part including at least two units which are so arranged in common on a rear side of the elevator car and mechanically positively connected with the elevator car that during the drive mode each of said two units produces a movement along one of said interaction surfaces to thereby move the elevator car.

2. The elevator installation according to claim 1 wherein the stationary part is polygonal in cross-section perpendicular to the longitudinal axis and said surface normals of said two interaction surfaces are inclined away from or towards one another.

3. The elevator installation according to claim 1 wherein between a first one of said two interaction surfaces and a first one of said two units there is a first traction force substantially parallel to said surface normal of said first one interaction surface and between a second one of said two interaction surfaces and a second one of said two units there is a second attraction force substantially parallel to said surface normal of said second one interaction surface.

4. The elevator installation according to claim 3 wherein said first and said second attraction forces act at least partly opposite one another and effective holding forces acting between each of said units and said respective interaction surface therefore reduce.

5. The elevator installation according to claim 1 wherein said inclined arrangement of said interaction surfaces compensates for torques resulting from an eccentric suspension of the elevator car due to the rucksack configuration.

6. The elevator installation according to claim 1 wherein said two units are arranged at a same height, but at a spacing from one another, on said rear side of the elevator car so as to produce a rotational stabilization of the elevator car about an axis extending parallel to the longitudinal axis.

7. The elevator installation according to claim 1 wherein said inclined arrangement of said interaction surfaces and corresponding attraction forces of said unit opposite respective ones of said interaction surfaces produces not only a rotational stabilization of the elevator car about an axis extending perpendicularly to the longitudinal axis and perpendicularly to said rear side of the elevator car, but also a rotational stabilization of the elevator car about an axis extending perpendicularly to the longitudinal axis and parallel to said rear side of the elevator car.

8. The elevator installation according to claim 1 wherein due to said inclined arrangement of said interaction surfaces the stationary part serves as a three-dimensional guide element for a vertical movement of the elevator car along the shaft wall.

9. The elevator installation according to claim 1 wherein said units are separated from the stationary part by an air gap and contactlessly guide vertical movement of the elevator car along the shaft wall.

10. The elevator installation according to claim 1 including a guide shoe that guides vertical movement of the elevator car on a guide rail.

11. The elevator installation according to claim 1 an emergency guide provided in an upper region of the elevator car which engages at least partly around or behind the stationary part in order to prevent tipping away of the elevator car in case the linear drive system should fail or the attraction forces produced by the linear drive system should drop away.

12. The elevator installation according to claim 1 including a rest in an upper region of the stationary part which is adapted to mount shaft components including at least one of a position transmitter, a brake partner of a holding brake and a mechanically positively acting holding lock.

13. The elevator installation according to claim 1 wherein the linear drive system includes at least one permanent magnet or at least one layer structure with at least one coil.

14. A linear drive system for use in an elevator installation with a stationary part, the longitudinal axis of which is arranged vertically along a shaft wall of the elevator installation, and with a movable part that moves along the stationary part when the linear drive system is controlled in a drive mode, comprising:

the stationary part including at least two inclined interaction surfaces that extend parallel to the longitudinal axis and lie in a plane including an angle between 0° and 180°;

the stationary part being mounted in front of or at a rear wall of the elevator shaft or a building wall; and the movable part including at least two units mechanically positively mounted in common on a rear side of the elevator car at a car frame, wherein the linear drive system moves the elevator car by the units which are movable along the stationary part when the linear drive system is controlled in the drive mode.

15. The linear drive system according to claim 14 including at least one permanent magnet or at least one layer structure with at least one coil.

* * * * *